United States Patent [19]

Iwano et al.

[11] Patent Number: 4,918,613

[45] Date of Patent: Apr. 17, 1990

[54] EXCHANGE COMPONENT TRANSPORT CONTROL SYSTEM FOR LOOMS

[75] Inventors: Yoshimi Iwano; Masanobu Sakai; Hajime Suzuki, all of Kariya, Japan

[73] Assignee: Kabushiki Kaisha Toyoda Jidoshokki Seisakusho, Kariya, Japan

[21] Appl. No.: 231,087

[22] Filed: Aug. 11, 1988

[30] Foreign Application Priority Data

Aug. 24, 1987 [JP] Japan ..... 62-209739

[51] Int. Cl.[4] ..... G06F 15/46; B65G 35/00

[52] U.S. Cl. ..... 364/478; 364/468; 364/470

[58] Field of Search ..... 364/468, 470, 478; 139/1 R; 414/786

[56] References Cited

U.S. PATENT DOCUMENTS 4,621,410 11/1986 Williamson ..... 29/568
4,630,216 12/1986 Tyler et al. ..... 364/478
4,736,324 4/1988 Sainen et al. ..... 364/470
4,766,547 8/1988 Modery et al. ..... 364/478
4,813,540 5/1989 Hesser ..... 364/468

*Primary Examiner*—Jerry Smith
*Assistant Examiner*—Paul Gordon
*Attorney, Agent, or Firm*—Brooks, Haidt, Haffner & Delahunty

[57] ABSTRACT

A loom supervising system including a supervising computer adapted to fetch the weaving information including the information concerning warp or weft breakage or weft insertion errors for each of a plurality of looms and a multiplexor type relaying unit provided on a signal line interconnecting the supervising computer and the looms. To this relaying unit is connected a transport car control board of an unmanned transport car adapted for transporting exchange components such as the warp beam or the cloth roll. Prescribed command signals from the control board of the transport car are transmitted to a deceleration stop command device provided at each loom by way of the relaying unit and the monitoring signal line.

12 Claims, 8 Drawing Sheets

EXCHANGE COMPONENT TRANSPORT CONTROL SYSTEM FOR LOOMS

BACKGROUND OF THE INVENTION

1. Field of the Invention

This invention relates to a control system for transporting exchange parts or components for looms, such as warp beams or cloth rolls.

2. Prior Art

In a weaving plant equipped with a large number of looms, the deceleration and stop of an unmanned transport car employed for exchanging warp beams or cloth rolls are controlled by deceleration stop commands transmitted from a transport car control board to the deceleration stop command transmitter provided in each loom, and the command transmission lines interconnecting the respective deceleration stop command transmitters and the transport car control board are connected in parallel with one another.

Such parallel wiring is inconvenient in connection with the wiring space or costs in wiring construction works and represents an obstructive factor to the promotion of unmanned transport control for the warp beams or cloth rolls.

SUMMARY OF THE INVENTION

In order to remove the above disadvantages, the present invention provides a loom supervising system wherein a multiplexor relaying unit is installed on a monitoring signal line interconnecting a plurality of looms and supervisory computer for fetching a weaving information including information concerning warp or weft breakage or weft insertion errors for each loom. Transport control means for controlling the transport of an unmanned transport car adapted to transport exchange parts or components such as warp beams or cloth rolls is connected to the relay unit. Prescribed command signals are transmitted from the transport control means to an unmanned transport car stop command transmitting means by way of the relaying unit and the monitoring signal line.

The stop command signals are transmitted by the multiplexor relaying unit such that stop commands may be transmitted to the unmanned transport car stop command transmitting means provided in a prescribed one of the looms, by way of a monitoring signal line interconnecting the looms in series. This results in a transport system construction which is favorable in connection with construction works and the space for electrical wiring. In the pre-existing monitoring system including the multiplexor relaying unit, only a minimum amount of additional system components need be annexed to the system.

BRIEF DESCRIPTION OF THE DRAWINGS

In the course of the following detailed description, reference will be made to the attached drawings in which.

BRIEF DESCRIPTION OF THE PREFERRED EMBODIMENTS

A warp beam transport control system according to a first embodiment of the present invention will be explained hereinbelow by referring to FIGS. 1 to 4.

Figure 1:
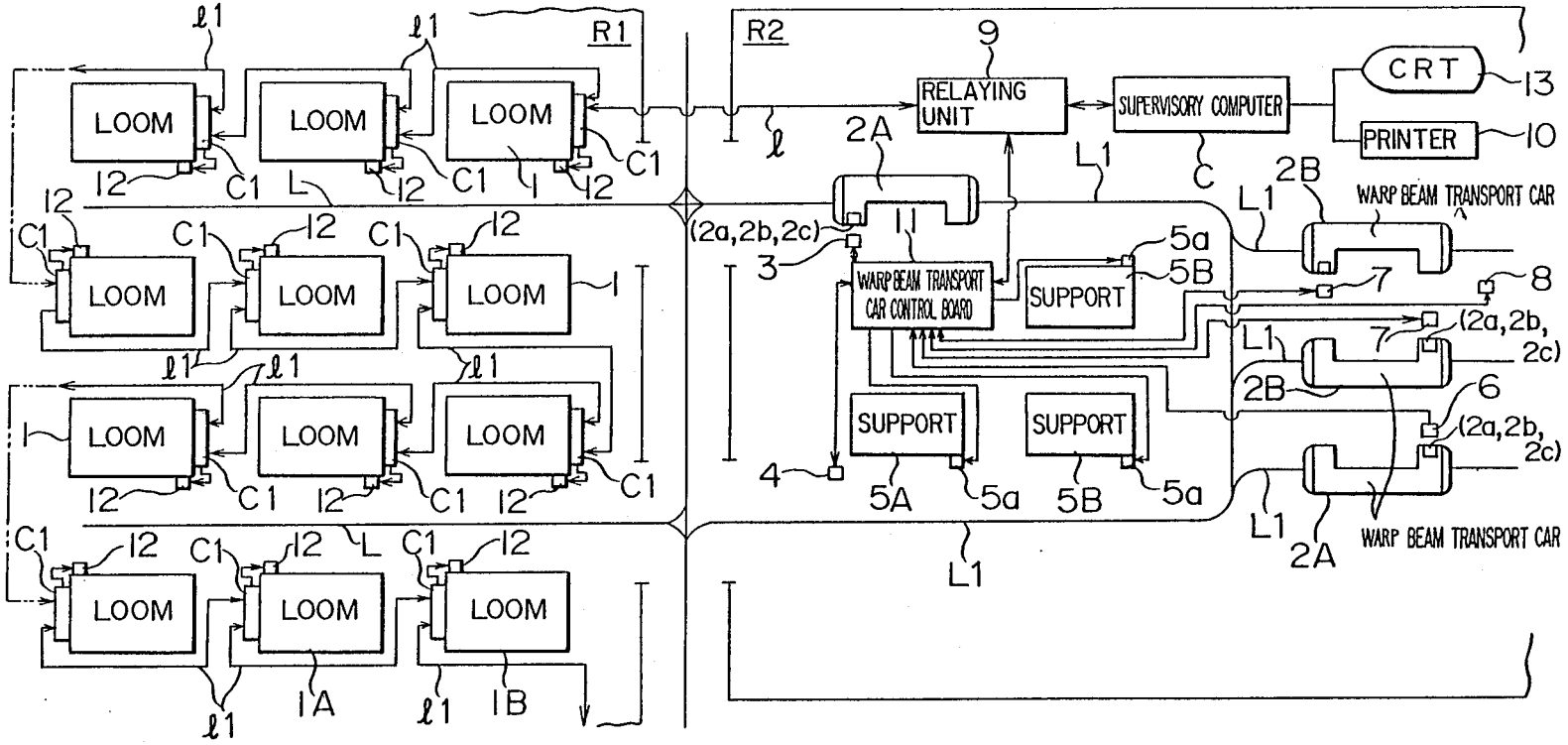
FIG. 1 is a block diagram showing a transport system for a warp beam transport car according to a first embodiment of the present invention.

As shown in FIG. 1, a number of looms such as the looms 1, 1A and 1B are arranged in a weaving chamber R1. A guide line L for guiding the transport of warp beam transport cars 2A and 2B is laid on or inside a floor intermediate the adjacent loom rows toward the rear side of the looms. The guide line L is connected to a guide line L1 in a preparative chamber R2. A home station 3, a destination or transition station 4, a stand-by station 6 for warp beam transport cars 2A dedicated to transport of empty warp beams, a stand-by station 7 for warp beam transport cars 2B dedicated to transport of full warp beams and a maintenance station 8 are provided along the guide line L1. There are also installed a support or rest 5A dedicated to supporting the empty warp beams and similar supports or rests 5B dedicated to supporting the full warp beams.

A loom control computer C1 is provided for each of the looms 1, 1A and 1B. Each loom control computer C1 fetches and stores weaving information relating to, for example, warp breakage, weft breakage, weft inserting errors and the number of times of weft insertion, as well as a weaving information concerning looming, that is, the operation of installing a new warp beam on a loom and passing the warp towards the loom, and concerning the cessation of the loom operation accompanying cloth cutting. The fetched weaving information is in turn brought into a supervisory computer C through a multiplexor relaying device 9 provided with a scanning function and constituting a monitoring system. The supervising computer C commands a printer 10 periodically to print out the fetched weaving information, which registering the information of warp or weft breakage or weft insertion error likely to cause weaving defects after allotting identification indicia thereto. The numeral 13 denotes a display CRT. The relaying unit 9 is interposed on a monitoring signal line l interconnecting the supervising computer C and the loom control computer C1 of a specific one of the large number of looms. Connected to this relaying unit 9 is a warp beam transport car control board 11 such that the control computer C1 of the specified loom 1 is connected in series with the control computer C1 of another one of the looms by a monitoring signal line l1.

Figure 3:
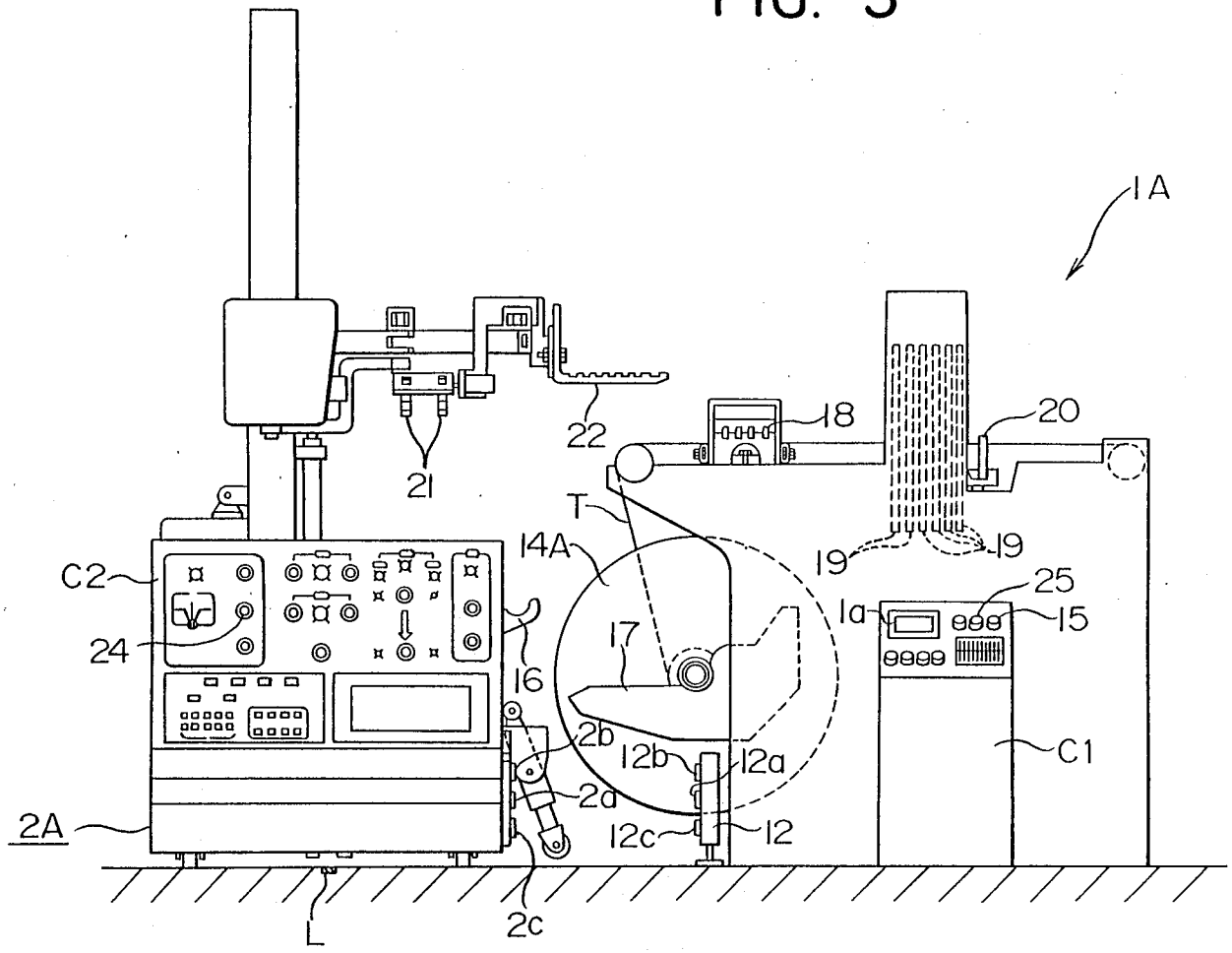
FIG. 3 is a side elevation of the loom and the warp beam transport car employed in the transport system shown in FIG. 1.

As shown in FIGS. 1 and 3, deceleration/stop command posts 12 are provided towards the rear of the looms 1, 1A and 1B, that is, towards the side where the guide line L is laid. The post 12 of a specific one of the looms is connected to the relaying unit 9 through the loom control computer C1 by the monitoring signal line l, while the post 12 of another loom is connected directly to each other through the loom control computer C1. The weaving information fetched into the supervisory computer C1 is transmitted from an optical communication unit 12*a* of the command post 12 under the operating instructions of the control board 11. The light information thus transmitted is received by optical communication units 2*a* of the warp beam transport cars 2A and 2B halted ahead of the loom so that the information is fetched into the transport car control computers C2 of the warp beam transport cars 2A and 2B. In each of the deceleration stop command posts 12, a deceleration command transmitter 12*b* and a stop command transmitter 12*c* each comprised of a photo-electric switch, not shown, are provided in juxtaposition to each other and on the upper and lower sides of the optical communication unit 12*a*. The light rays transmitted from the deceleration command transmitter 12*b* are received by a deceleration command receiver 2*b* comprised of photoelectric sensors, not shown, of the warp beam transport cars 2A and 2B, whilst the light rays transmitted from the stop command transmitter 12*c* in the normally ON state are received by a stop command receiver 2C comprised of photo-electric sensors of warp beam transport cars 2A and 2B. The transport car control computer C2 of the warp beam transport cars 2A and 2B performs a deceleration control of the warp beam transport cars 2A and 2B on the basis of deceleration commands fetched from the deceleration command transmitter 12*b*, while also performing stop control of the warp beam transport cars 2A and 2B so that these cars will be stopped in controlled manner at a position facing to a loom adjacent to the loom transmitting the deceleration commands on the basis of the stop commands transmitted from the stop command transmitter 12*c* of the loom lying ahead of the cars.

The home station 3 and the destination station 4, each including an optical communication unit and a photoelectric switch type deceleration stop command transmitter, are adapted to transmit the command information from the optical communication unit under the command operations from the transport car control board 11. The home station 3, destination station 4 and the transport car control board 11 connected to the relaying unit 9 are connected in parallel with a communication post 5*a* comprised of a photo-electric switch type deceleration stop command transmitter and an optical communication unit installed in each support 5, stand-by stations 6, 7 and the maintenance stations 8, these stations 6 to 9 having a construction similar to that of the above stations.

Figure 4:
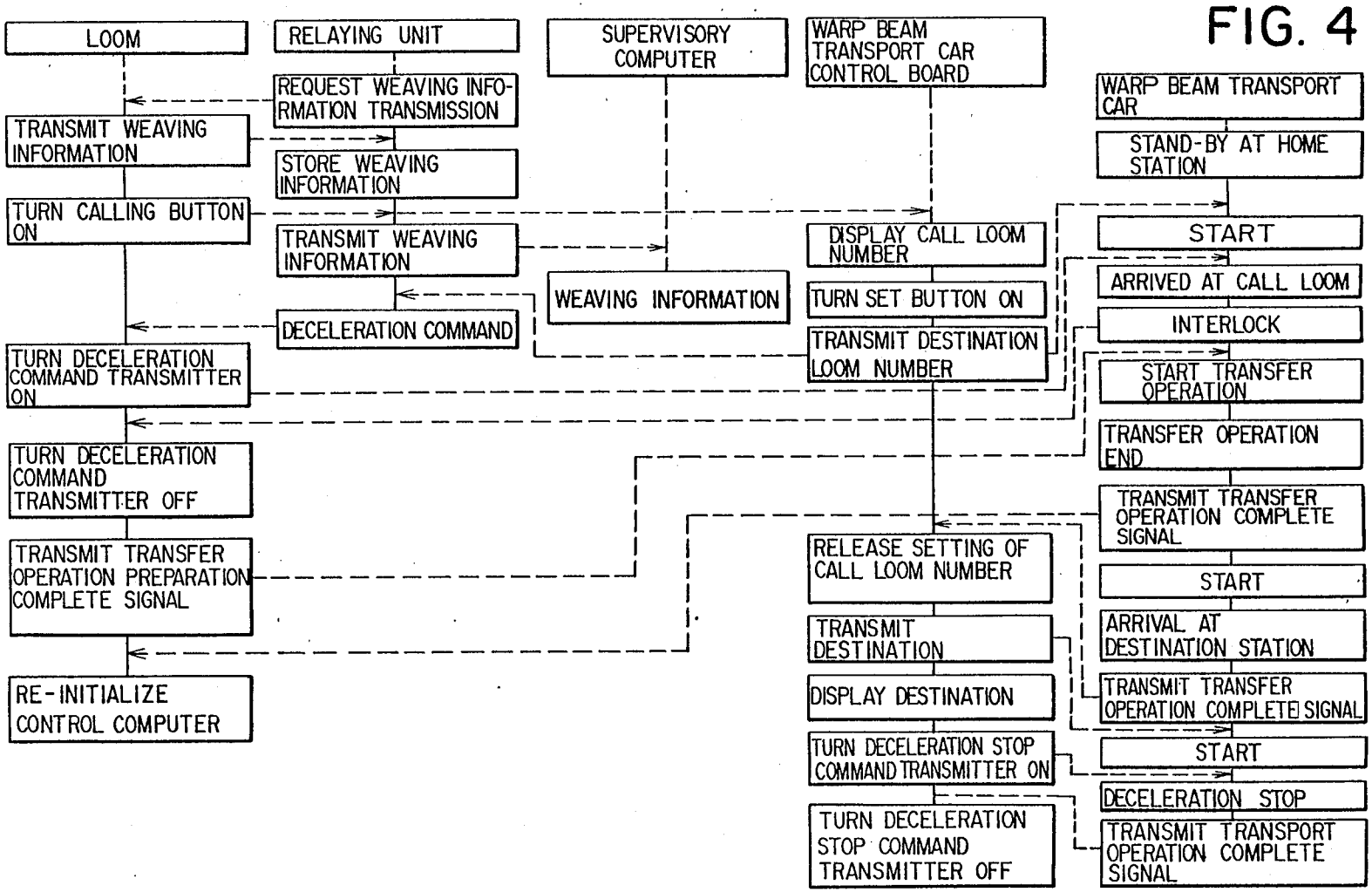
FIG. 4 is a flow chart showing the interrelationship between and the functional operations of the supervisory computer, relaying unit, looms, warp beam transport car control boards and the warp beam transport cars.

FIG. 4 is a flow chart showing the functional operations of and the relation between the supervisory computer C, relaying unit 9, looms 1, 1A and 1B, warp beam transport control board 11 and warp beam transport cars 2A and 2B. The warp beam transport control is explained hereinbelow in accordance with the flow chart and by referring to FIGS. 1 to 3.

The relaying unit 9 scans the looms sequentially to store the weaving information fetched into the loom control computer C1 including the number of weft insertions or loom stops caused in connection with weaving defects, such as warp or weft breakage or weft inserting errors. When a warp beam 14A on a supporting bracket 17 of a loom, such as a loom 1A, is used up, an operator on the loom turns on a calling button 15 on a loom 1A for calling the warp beam transport car 2A dedicated to transport of the empty warp beam 14A. This calling signal S is transmitted to the relaying unit 9 while being also transmitted to the warp beam transport car control board 11 through the relaying unit 9. In response to the calling signal S, the relaying unit 9 transmits the stored weaving information to the supervisory computer C which, in response to the calling signal S, stores the fetched weaving information in an orderly condition.

Figure 2:
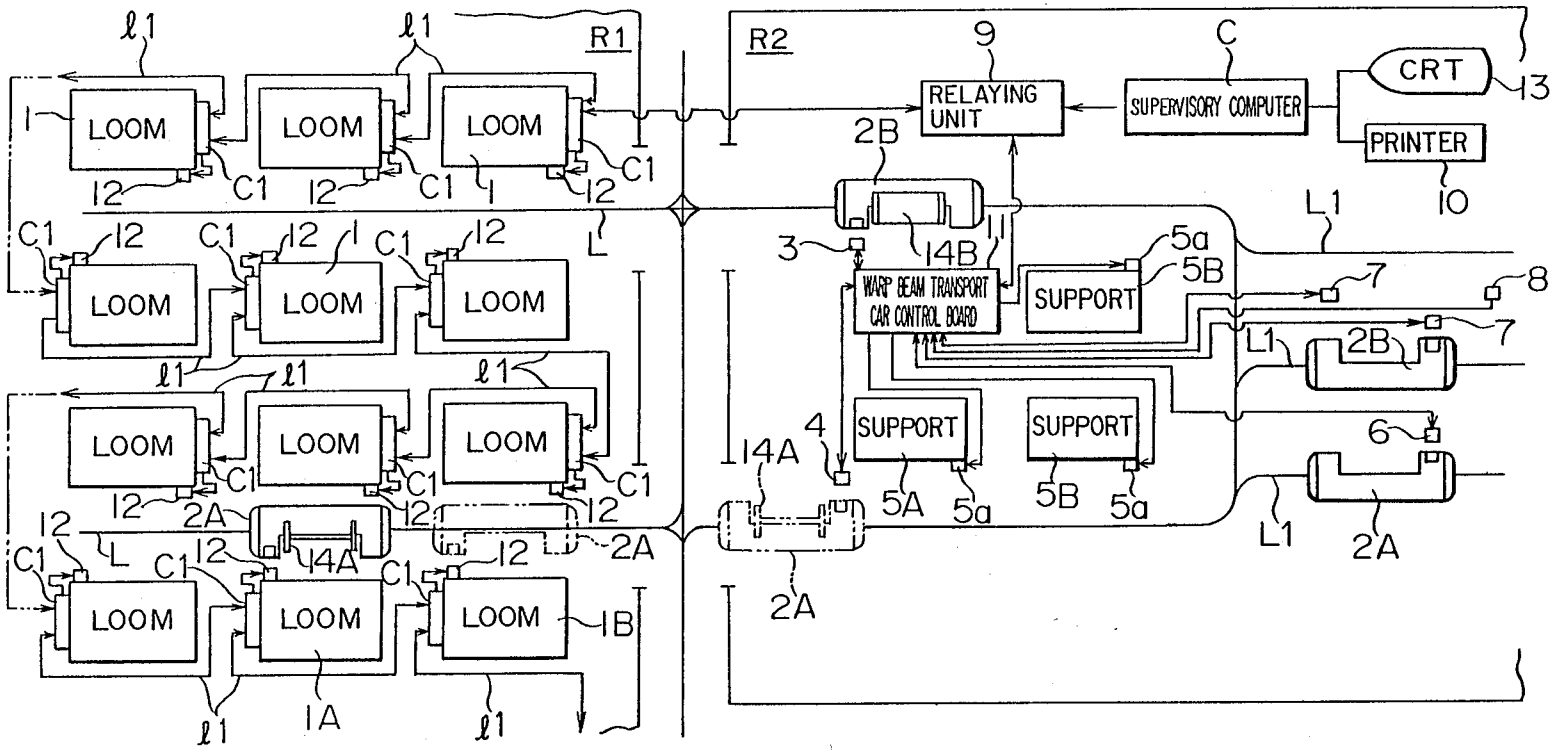
FIG. 2 is a block diagram similar to FIG. 1 but with the warp beam transport car in a different position.

On the transport car control board 11, an allocation number n of the calling loom 1A is indicated on a display panel, not shown, on the basis of the calling signal S, this indicated number n being transmitted by the turn-on operation of a setting button, not shown, by the operator, to the relaying unit 9 and the transport car control computer C2 on the warp beam transport car 2A, which is in a stand-by state at the home station 3, by way of the optical communication unit 2*a*. This causes the transport car control computer C2 of the warp beam transport car A2 to issue start commands in response to reception of the called loom n. Upon reception of the called loom number n, the relaying unit 9 transmits deceleration commands to the deceleration stop command post 12 of the loom 1B adjacent the loom 1A bearing the called loom number n, such that the deceleration command transmitter 12*b* of the deceleration stop command post 12 is turned on. The warp beam transport car 2A is directed to the calling loom 1A along a preprogrammed transport passage, so as to be decelerated as the ON state of the decelerating command transmitter 12*b* of the loom 1B is ascertained via deceleration command receiver 2*b*, so as to be then stopped at a position facing to the loom 1A as shown in FIG. 2, after the ON state of the stop command transmitter 12*c* of the deceleration stop command post 12 of the called loom 1A is ascertained via stop command receiver 2C.

The deceleration command signals transmitted by the multiplexor relaying unit 9 is transmitted in a time sharing manner on a monitoring signal line l interconnecting a large number of data transmitting units of the relaying unit 9 and data receiving units of a large number of deceleration stop command posts 12, the monitoring signal line being shared by the numerous deceleration stop command posts 12. Therefore, warp beam transport car control board 11 and the numerous deceleration stop command posts 12 intended for delivery of the warp beam transport car 2A to the desired loom may be connected in series by the intermediary of the relaying unit 9. This means that the costs involved in wiring construction works and the wiring space can be significantly reduced as compared to the case of parallel interconnection of the prior art system. When a monitoring system similar to the monitoring system of the present embodiment including the relaying unit 9 and the supervisory computer C is already provided to perform an operational control of a large number of looms, the warp beam transport control system of the present embodiment can be implemented by a simple system change including forming an interconnection between the relaying unit 9 and the warp beam transport car control board 11 for minimizing the new system construction.

The transmission of the calling signal S by the turn-on operation of the calling button 15 is performed through the monitoring signal line l and the relaying unit 9, similarly to the transmission of the deceleration command signals, such that a signal line for the calling signal S requesting the operator on the warp beam transport car control board 11 to call the warp beam transport car 2A need not be installed in parallel or in series between each loom 1 and the warp beam transport car control board 11. Hence, in the transport control system of the present invention wherein the warp beam transport car control board 11 is connected to the monitoring system including the interposed multiplexor relaying unit 9, the monitoring system can be utilized in connection with the totality of the data transmission and reception operations between the warp beam transport car control board 11 and each of the loom control computers C1.

The warp beam transport car 2A, which is at a standstill ahead of the called loom 1A, collates the stored number of the called loom n with the called loom number n transmitted from the loom 1B and, if the two numbers coincide with each other, interlocks the loom 1B with the transfer device of the warp beam transport car 2A. At this time, the deceleration command transmitter **12*b* of the deceleration stop command post 12 of the loom 1A is turned off. The transfer operation is started after reception of a signal from the loom 1A indicating the end of the preparation for the transfer operation at the loom 1A to the effect that the warp breakage sensor 18, heddle 19 and the reed 20, through which is passed a warp T from the empty warp beam 14A, can be dismounted from the loom 1A. The signal from the loom 1A indicating the end of the preparation for the transfer operation is transmitted via optical communication unit 12*a* of the deceleration stop command post 12 and via optical communication unit 2*a* of the warp beam transport car 2A to the transport car control computer C2 of the warp beam transport car 2A. The empty warp beam 14A is transferred from the support bracket 17 onto the warp beam transport car 2A by a transfer lever 16 movable both vertically and in the fore and aft direction, while the warp breakage sensor 18, heddle 19 and the reed 20 are transferred towards the warp beam transport car 2A by suspension hooks 21 and 22** movable both vertically and in the fore and aft direction.

After completion of the transfer operation, the transfer operation end or completion signal is transmitted from the warp beam transport car 2A to the loom 1A via optical communication units **2*a* and 12*a*, so that the loom control computer C1 of the loom 1A is initialized, and that at the same time the warp beam transport car 2A is started towards the destination station 4. The warp beam transport car 2A arriving at the destination station 4 transmits the transfer operation end signal to the warp beam transport car control board 11 through the destination station 4 and releases the setting of the calling loom number n on the basis of reception of the transfer operation end signal. The car 2A also commands the support of destination 5A to the transport car control board 11. As the operator turns on a start button 24, the warp beam transport car 2A is started towards the commanded support 5A. After the car 2A arrives at the support 5A, the empty warp beam 14A, warp breakage sensor 18, heddle 19 and the reed 20 on the warp beam transport car 2A are transferred onto the support 5A**.

After the termination of the transfer operation onto the support 5A, the operator on the warp beam transport car control board 11 issues an ON command to a deceleration stop command starter of the home station 3 or the stand-by station 6 on the basis of the state of vacancy of the stations 3 and 6, while issuing a destination command to the warp beam transport car 2A. This causes the warp beam transport car 2A to be started towards the home station 3 or towards the stand-by station 6 as the start button 24 is turned on. When the home station 3 is vacant, the warp beam transport car 2A is sent preferentially to the home station 3. The warp beam transport car 2A arriving at the station 3 or 6 transmits transport operation end signal to the warp beam transport car control board 11 via station 3 or 6. Based on reception of the transport operation end signal, the operation of the warp beam transport car control board 11 turns off the deceleration stop command transmitter of the station 3 or 6.

After the end of the transfer operation of the empty warp beam 14A on the loom 1A, the operator on the loom turns on the start button 24 of the warp beam transport car 2A while also turning on a calling button 24 on the loom 1A for calling the warp beam transport car 2B dedicated to transport of the full warp beam 14B. This calling signal S1 is transmitted to the relaying unit 9 while being simultaneously transmitted through the relaying unit 9 to the warp beam transport car control board 11. In the transport car control board 11, the allocation number n of the called loom 1A and the kind of the fabric being processed in the called loom 1A of the allocation number n are indicated on a display panel, not shown, on the basis of the calling signal S1. The operator on the warp beam transport car control board 11 then selects the full warp beam 14B conforming to the displayed fabric kind, the warp breakage sensor, the heddle and the reed through which the warp of the warp beam 14B is passed, and the support 5B on which the reed is stocked, while turning on the deceleration stop command starter of the communication post 5a of the selected support 5B by the operation on the warp beam transport car control board 11. Thus, the number m allotted to the selected support 5B is transmitted to any one of the warp beam transport cars 2B that are in the stand-by state at the stand-by station 7. This causes the transport car control computer C2 of the warp beam transport car 2B to issue start commands in reponse to reception of the number m so that the warp beam transport car 2B is started towards the support 5B to which the number m is allocated.

Upon arriving at the support 5B to which the number m is allocated, the warp beam transport car 2B has the full warp beam 14B, warp breakage sensor, heddle and the reed transferred thereto from the support 5B, before being started towards the home station 3 by the turn-on operation of the start button 24. Upon arriving at the home station 3, the warp beam transport car 2B transmits the arrival signal to the warp beam transport car control board 11 via home station 3. Then, responsive to reception of the arrival signal, the operator of the warp beam transport car control board 11 transmits the called loom number n to the loom control computer C1 of the warp beam transport car 2B via relaying unit 9 and home station 3. This causes the warp beam transport car 2B to travel in the direction of the called loom 1A along a preprogrammed transport path. The transport control similar to that for the warp beam transport car 2A described hereinabove is then performed so that the full warp beam 14B is transferred to the loom 1A and restored to the preparative chamber R2.

The deceleration stop command post 12 adapted to control the deceleration and stop of the warp beam transport car 2A is also responsible for data reception and transmission between the transport car control computer C2 for the warp beam transport car 2A and the loom control computer C1, such that the warp beam transport car 2A is enabled to perform data reception and transmission with the warp beam transport car control board 11 through the loom control computer C1.

A second embodiment of the present invention will now be explained by referring to FIGS. 5 to 7.

Figure 5:
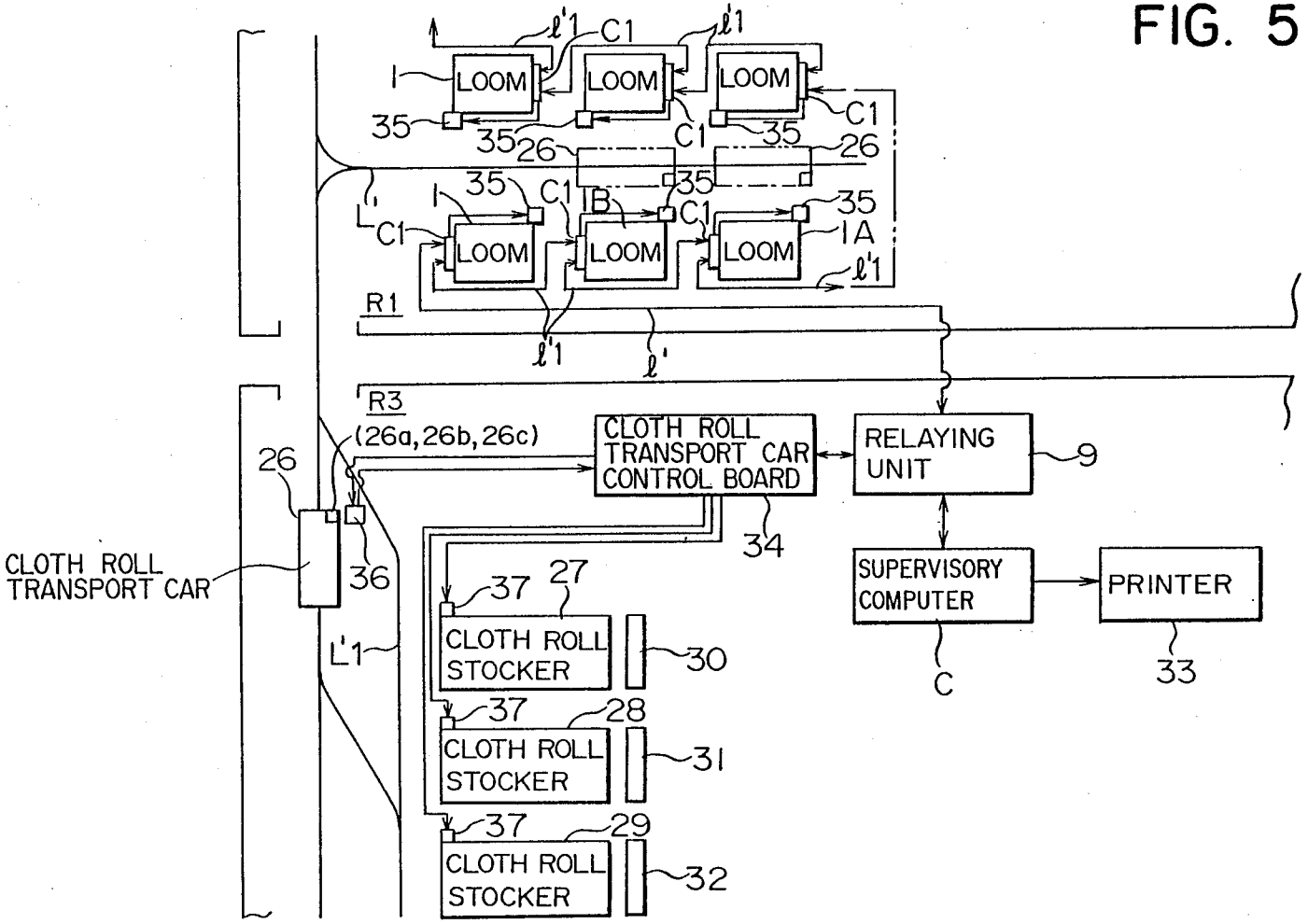
FIG. 5 is a block diagram showing a transport system for a cloth roll transport car according to a second embodiment of the present invention.

As shown in FIG. 5, a guide line L' for guiding the transport of a cloth roll transport car 26 is laid on the floor between adjacent rows of a number of looms, 1, 1A, 1B provided in a weaving chamber R1. The guide line L' is connected to a loading position L'1 for stockers 27, 28 and 29 within a cloth roll stock chamber R3, such that a cloth roll transported by a cloth roll transport car 26 to the loading position L'1 will be transferred to and suspended from one of the stockers 27, 28 and 29 each comprised of a shifting chain and a number of suspension stock units arrayed in the chain. Inspection and opening machines 30 and 31 are installed adjacent to the sides of the stockers 27 and 28 opposite to the loading position L'1 of the stockers 27 and 28, and an opening machine 32 is installed in the vicinity of the stocker 29.

A loom control computer C1 installed at the looms 1, 1A and 1B fetches and stores a weaving information concerning the warp and weft breakages, weft inserting errors and the number of times of weft insertions, as well as a weaving information regarding the loom stop accompanying the looming and cloth cutting operations. The fetched weaving information is then brought into a supervisory computer C by way of a relaying unit 9 similarly to that of the preceding embodiment. The supervisory computer C commands a printer 33 periodically to print out the thus fetched weaving information, while registering the information concerning warp or weft breakage or weft insertion errors likely to cause weaving defects after allotting identification indiscia thereto. The relaying unit 9 is interposed on a monitoring signal line 1' interconnecting the supervisory computer C and the loom control computer C1 of a specified one of the large number of looms, such as a loom 1 adjacent to the loom 1B. Connected to the relaying unit 9 is a cloth roll transport car control board 34 such that the control computer C1 of the loom 1 is connected in series with the control computer C1 of another of the looms by a monitoring signal line 1'1.

Figure 6:
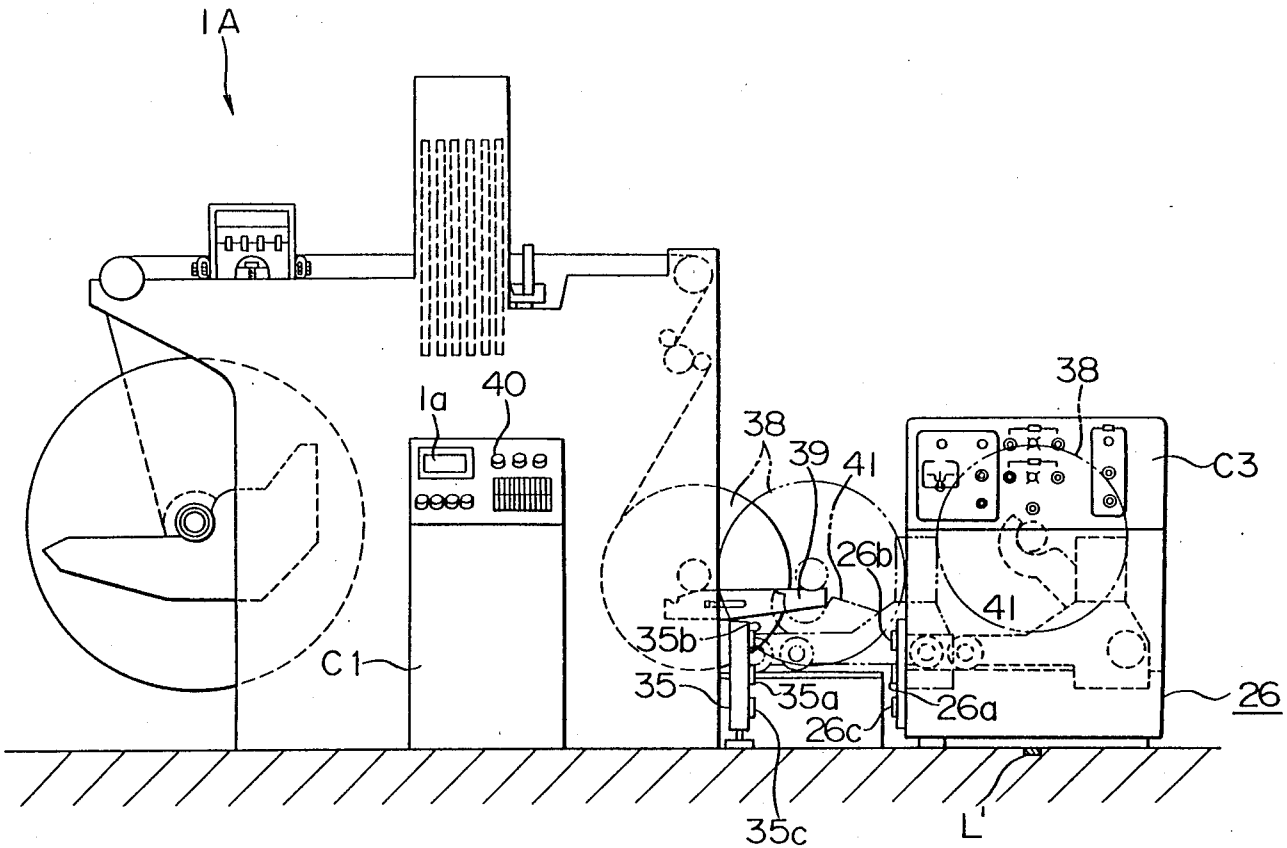
FIG. 6 is a side elevation showing the loom and the cloth roll transport car in the transport system of the second embodiment.

As shown in FIGS. 5 and 6, deceleration stop control posts 35 similar to the posts 12 of the preceding embodiment are installed towards the front side of the looms 1, 1A and 1B, that is, towards the side where the guide line L' is laid. The receleration stop command post 35 of the specified loom 1 is connected to the relaying unit 9 via loom control computer C1 and monitoring signal line 1', while the deceleration stop command post 35 of the specified loom 1 and the deceleration stop command post 35 of another of the looms are connected directly to each other by the loom control computer C1. The weaving information fetched by the supervisory computer C is adapted to be transmitted from an optical communication unit 35*a* of the post 35 under the operational commands of the cloth roll transport car control board 34. The transmitted optical communication information is received by an optical communication unit 26*a* of a cloth roll transport car 26 halted in front of the loom so as to be then fetched by the transport car control computer C2 of the cloth roll transport car 26. In each of the deceleration stop command post 35, a deceleration command transmitter 35*b* and a stop command transmitter 35*c* are installed in juxtaposition to each other and on the upper and lower sides of the optical communication unit 35*a*. The light rays transmitted from the deceleration command transmitter 35*b* are received by a deceleration command receiver 26*b* comprised of a photo-electric sensor, not shown, of the cross roll transport car 26, while the light transmitted from a stop command transmitter 35*c* in the normally ON state is received by a stop command receiver 26*c* comprised of a photo-electric sensor of the cloth roll transport car 26. A transport car control computer C3 of the cloth roll transport car 26 performs deceleration control of the cloth roll transport car 26 on the basis of the deceleration command fetched from the deceleration command transmitter 35*b*, such that the cloth roll transport car 26 is stopped in a controlled manner for facing to a loom adjacent to the loom transmitting the deceleration commands, on the basis of the stop commands transmitted from the stop command transmitter 35*c* of the loom lying opposite to the car 26.

A home station 36 comprised of a photo-electric switch type stop command transmitter and an optical communication unit is installed at the exit side of a cloth roll stock chamber R3, and a command information is transmitted from the home station 36 under the command operation of the cloth roll transport car control board 34. The control board 34 connected to the home station 36 and to the relaying unit 9 is also connected in parallel with a communication post 37 provided with a deceleration stop command function for the stocker 27.

Figure 7A:
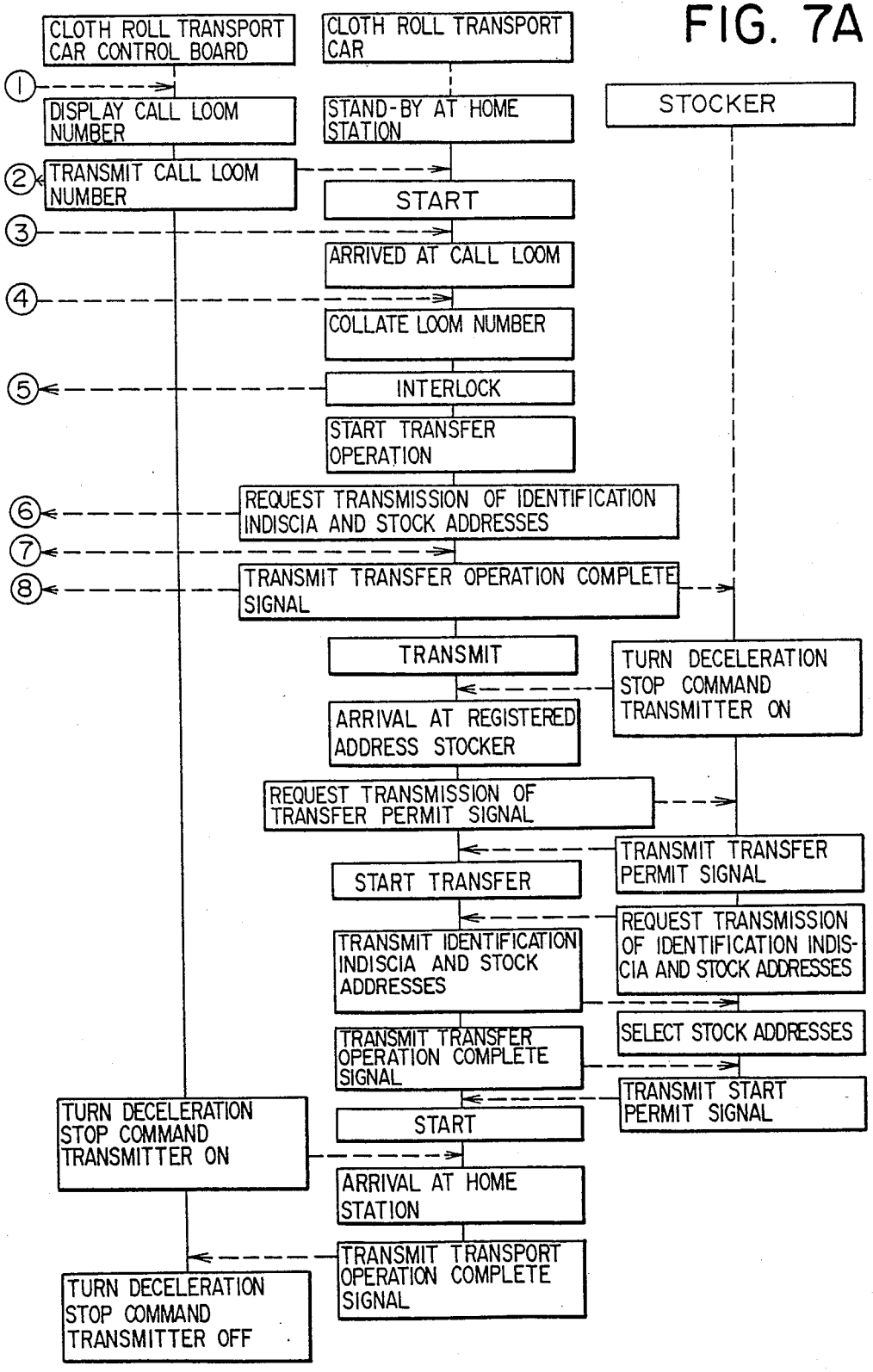
FIGS. 7A and 7B are flow charts showing the interrelationship between and the functional operations performed by the supervisory computer, relaying unit, looms, cloth roll transport car control boards, cloth roll transport cars and the stockers.
Figure 7B:
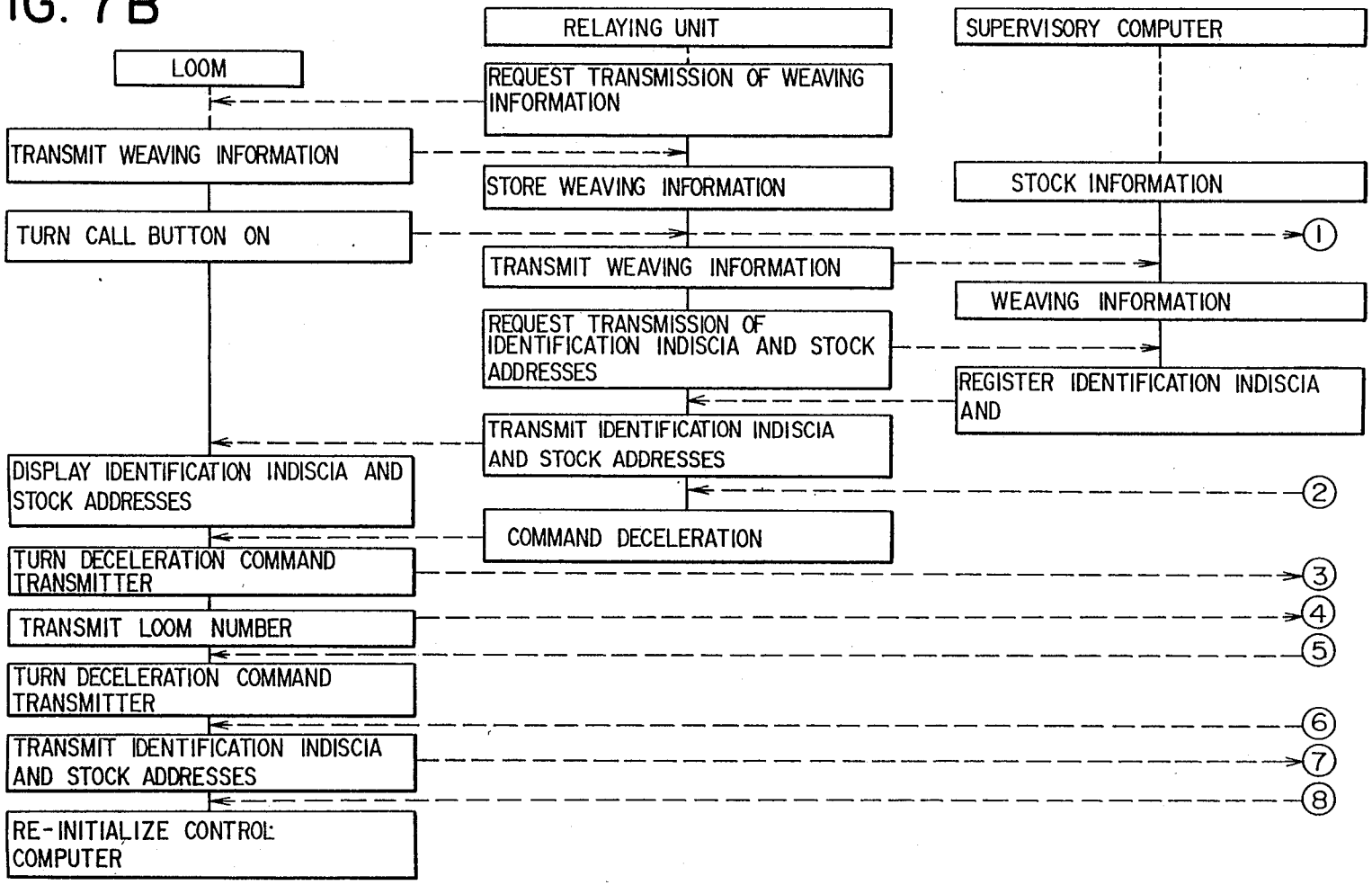

FIG. 7 is a flow chart showing the relation between and the functional operations performed by the supervisory computer C, relaying unit 9, looms 1, 1A and 1B, cloth roll transport car control board 34, cloth roll transport car 26 and the stockers 27, 28 and 29, The cloth roll transport control process will now be explained with reference to this flow chart. It will be noted that the flow chart of FIG. 7A and that of FIG. 7B are interconnected as indicated by dotted symbol lines ① to ⑧.

The relaying unit 9 scans the looms sequentially to store the weaving information temporarily in the same way as in the preceding embodiment. Supposing that a woven fabric has been completed at a loom 1A, for example, the operator takes out a cloth roll 38 as indicated in FIG. 6 and shifts the roll to a position at the foremost part of the bracket 39. The operator then turns on a calling button 40 on the loom 1A. This calling signal S' is transmitted to the relaying unit 9 while being transmitted through the relaying unit 9 to the cloth roll transport car control board 34. The relaying unit 9 is responsive to the calling signal S' to transfer the stored weaving information to the control computer C, while requesting the supervisory computer C to transmit the identification indiscia and stock addresses of the cloth roll completed at the loom 1A.

Responsive to the calling signal S', the supervisory computer C puts the fetched weaving information in order and stores the weaving information after allocating and registering the identification indiscia thereto and allocating and registering the stock addresses on the basis of the stock information obtained from the control computers, not shown, of the stockers 27, 28 and 29. The stock address allocation and registration is performed in dependence on the grasped contents of the weaving information put into order as mentioned hereinabove, in such a manner that, when the amount of the information in the above weaving information possibly leading to weaving defects, such as warp or weft breakage or weft inserting errors, is in excess of a prescribed threshold value, the addresses of the stockers 27 or 28 are allocated as the stock addresses and, when such amount is below the prescribed threshold value, the addresses of the stocker 29 are allocated as the stock addresses. The identification indiscia and the stock addresses thus allocated and registered for the stored weaving information are transmitted to the relaying unit 9 and to the cloth roll transport car 26 that is in the stand-by state at the home station 36. This causes the registered identification indiscia and the registered stock addresses to be transmitted to and stored in the loom control computer C1 of the loom 1A via relaying unit 9 and be displayed on a display panel 1*a* of the loom 1.

In the transport car control board 11, the allocated number n of the called loom 1A is displayed on a display panel, not shown, on the basis of the calling signal S'. The operator transmits the displayed number n to the relaying unit 9 and to the transport car control computer C3 of the cloth roll transport car 26, which is in the stand-by state at the home station 36, by way of the optical communication unit 26*a*. This causes the transport car control computer C3 of the cloth roll transport car 26 to issue a start command responsive to the received number of the called loom n. On reception of the number of the called loom n, the relaying unit 9 issues deceleration commands to the deceleration stop command post 35 of the loom 1B disposed ahead of the loom 1A corresponding to the called loom number n, so that the deceleration signal transmitter 35*b* of the deceleration stop command post 35 is turned on. The cloth roll transport car 26 is directed towards the called loom 1A along the preprogrammed transport route, so as to be decelerated after confirming the turn-on state of the deceleration command transmitter 35*b* of the loom 1B, so as to be then stopped ahead of the loom 1A after confirming the turn-on state of the stop command transmitter 35*c* of the deceleration stop command post 35 of the called loom 1A via stop command receiver 26*c*. Thus, a number of deceleration stop command posts 35 controlling the deceleration and stop of the cloth roll transport car 26 are adapted for receiving deceleration stop commands from the cloth roll transport car control board 34, the signal network constituting the monitoring system being used for transport control of the cloth roll transport car 26, as in the preceding embodiment.

The warp beam transport car 2A, which is stopped ahead of the called loom 1A, collates the stored number of the called loom n with the number of the called loom n transmitted from the loom 1B and, if the two numbers coincide with each other, interlocks the loom 1B with the transfer device of the cloth roll transport car 26 before starting the transfer operation. The cloth roll transport car 26 also requests the loom control computer C1 of the loom A1 to transmit the registered identification indiscia and the registered stock addresses thereto. This causes the registered identification indiscia and the registered stock addresses to be transmitted from the loom control computer C1 to the transport car control computer C3. The cloth roll 38 is now transferred from the bracket 39 onto the cloth roll transport car 26 by the operation of the lever 41 that is movable both vertically and in the fore and aft direction.

After termination of the loading operation, a transfer operation end signal is transmitted from the cloth roll transport car 26 to the loom 1A and to the stockers for the registered stock addresses. The loom control computer C1 of the loom 1A is initialized, while the cloth roll transport car 26 is started in the direction of the registered address stocker. When the registered address stocker is the stockers 27 or 28, the deceleration stop command transmitter, not shown, of the communication post 37 provided in the stockers 27 or 28 is previously turned on by the aforementioned transfer end signal and the cloth roll transport car 26 is stopped after confirming the turn-on state of the deceleration stop command transmitter of the communication post 37. When the cloth roll transport car 26 is stopped ahead of the stocker 27, the cloth roll transport car 26 requests a control computer, not shown, of the stocker 27, to transmit a transfer permit signal thereto via optical communication unit, not shown, of the communication post 37. The control computer of the stocker 27 transmits the transfer permit signal to the cloth roll transport car 26 while requesting the cloth roll transport car 26 to transmit the registered identification indiscia and registered stock addresses thereto. In response to this request, the registered identification indiscia and stock addresses are transmitted from the cloth roll transport car 26 to the stocker 27. On the basis of the transmission, the suspension stock units of the registered stock addresses are selected, shilek the cloth roll 38 on the transfer lever 41 is transferred onto the suspension stock units. The cloth rolls 38 stocked in the stocker 27 or 28 are sequentially supplied to the cloth inspecting machine 30 or 31 for inspection.

On the other hand, when the registered address stocker is the stocker 29, a deceleration stop command transmitter of the communication post 37, not shown, installed at the stocker 29, is previously turned on by the transfer end signal, such that the cloth roll transport car 26 is stopped ahead of the stocker 29 after confirming that the deceleration stop command transmitter of the communication post 37 is turned on. The cloth roll 38 on the transfer lever 41 is transferred to the suspension stock unit of the registered stock address. The cloth roll 38 stocked at the stocker 29 is supplied directly into the rolling and/or lapping machine 32 without being passed through the inspection step. That is, only the cloth rolls bearing the identification indiscia allocated to the weaving information possibly leading to the occurrence of weaving defects such as warp or weft breakages or weft insertion errors are passed to the inspection step, while the other cloth rolls that need not be inspected are not passed to the inspection step.

Upon completion of the cloth roll transfer operation from the cloth roll transport car 26 to the stocker 27, 28 or 29, the transfer operation completion signal is transferred from the cloth roll transport car 26 to the stocker 27, 28 or 29. Responsive to the transfer operation complete signal, a transmission permit signal is transmitted from the stocker 27, 28 or 29, whereby the cloth roll transport car 26 is started towards the home station 36. The deceleration stop command transmitter of the home station 36 is already turned on by the turn-on operation from the cloth roll transport car control board 34, such that the cloth roll transport car 26 is stopped after confirming that the deceleration stop command transmitter of the home station 36 is in the turned-on state. The cloth roll transport car 26 transmits the transport operation completion signal to the cloth roll transport car control board 34 via home station 36. Based on this transport operation complete signal, the deceleration stop command transmitter of the home station 36 is turned off automatically by signals from the cloth roll transport car control board 34.

The present invention is not limited to the above described embodiments. For example, the time of warp beam consumption or the time of completion of cloth weaving may be estimated by the supervising computer on the basis of the weaving information concerning the number of times of weft insertions and the estimated information may be transferred from the supervising computer to the transport car control board so as to be used for transport control of the warp beam transport car or cloth roll transport car. Alternatively, the kind or sort of the fabric in each of the looms may be grasped at the supervising computer and the fabric kind information may be transmitted from the supervising computer to the warp beam transport car control board to effect selective transfer of the warp beam suited to the specific fabric sort. Still alternatively, transport of the warp beam or the cloth roll in the above described first and second embodiments may be centrally controlled from a single relaying unit and a single transport car control board.

It is seen from the foregoing that the present invention provides a transport control system in which transport control means for controlling the transport of unmanned transport cars for transporting exchange components such as the warp beam or the cloth roll is connected to a multiplexor type relay unit constituting a monitoring system in conjunction with a supervisory computer, and in which prescribed command signals are transmitted from the transport control means to unmanned transport car stop command transmitting means provided in each of the looms, by way of the aforementioned relaying unit and a monitoring signal line, such that the transport car control board and each of the unmanned transport car stop command starting means can be connected in series with each other and there may be provided a transport system favorable not only in construction costs but in the wiring space. In addition, when the present invention is applied to a pre-existing monitoring system employing a multiplexor type relaying unit, only minimum additional components need be annexed to the pre-existing system.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. A transport control system for controlling the transport of an exchange component by an unmanned transport car toward and from a plurality of looms, said system comprising:

supervisory computer means connected to each of said looms by a monitoring signal line for fetching weaving information concerning warp breakage, weft breakage, weft insertion errors and/or the like for each loom;

a multiplexor relaying unit provided on said monitoring signal line intermediate said looms and said supervisory computer;

means disposed at each of said looms for transmitting a stop command for said unmanned transport car; and transport control means for transmitting a stop command over said monitoring signal line to said relaying unit, said relaying unit relaying said stop command to said stop command transmitting means.

2. The transport control system according to claim 1, further comprising a loom control installed in each of said looms, said monitoring signal line being connected in series with said looms through said respective loom control computers.

3. The transport control system according to claim 1, further comprising means installed in each loom and operatively connected with said supervisory computer for providing said transport car with a deceleration or stop command signal in response to a signal from said supervisory computer.

4. The transport control system according to claim 3, wherein each of said transport cars, and each of said means for providing a deceleration or stop command signal, includes an optical communication device, said optical communication device of each of said transport cars being constructed and arranged for receiving said deceleration or stop command signal from said optical communication device of said deceleration or stop command signal providing means.

5. The transport control system according to claim 3, wherein each of said means for providing a deceleration or stop command signal includes a deceleration command transmitter and a stop command transmitter, and each of said transport cars includes a deceleration command receiver and a stop command receiver for optically communicating with said deceleration command transmitter and said stop command transmitter, respectively.

6. The transport control system according to claim 5, wherein each said transport car includes means for causing said car to decelerate when its deceleration command receiver receives a deceleration command signal from said deceleration command transmitter of a loom adjacent another loom at which said transport car is to be stopped, and to stop when its stop command receiver receives a stop command signal from said stop command transmitter of said another loom.

7. The transport control system according to claim 1, wherein said relaying unit scans said looms sequentially for monitoring and storing weaving information therefore, and for receiving a transport car calling signal from a loom and transmitting it to said transport control means, and said relaying unit transmits said stored weaving information to said supervisory computer responsive to said received transport car calling signal.

8. The transport control system according to claim 7, wherein said transport control means includes a display panel on which an allocation number n is indicated of the loom from which a car calling signal is received.

9. The transport control system according to claim 1, wherein said exchange component is a warp beam.

10. The transport control system according to claim 9, wherein said transport control means is operatively connected in parallel with a home station, a destination station, an empty warp beam transport car stand-by station and a full warp beam transport car stand-by station.

11. The transport control system according to claim 1, wherein said exchange component is a cloth roll.

12. The transport control system according to claim 11, wherein said transport control means is connected in parallel with a home station and means for stocking a supply of cloth rolls.

* * * * *